US006844300B2

(12) United States Patent
Milner et al.

(10) Patent No.: US 6,844,300 B2
(45) Date of Patent: Jan. 18, 2005

(54) LOW PHOSPHORUS CLEAN GEAR FORMULATIONS

(75) Inventors: Jeffrey L. Milner, Midlothian, VA (US); Roger M. Sheets, Glen Allen, VA (US); David R. Ellis, Hampshire (GB); Rodney I. Barber, Berkshire (GB)

(73) Assignee: Ethyl Corporation, Richmond, VA (US)

( * ) Notice: Subject to any disclaimer, the term of this patent is extended or adjusted under 35 U.S.C. 154(b) by 292 days.

(21) Appl. No.: 10/076,094

(22) Filed: Feb. 15, 2002

(65) Prior Publication Data

US 2002/0160922 A1 Oct. 31, 2002

Related U.S. Application Data

(60) Provisional application No. 60/269,913, filed on Feb. 20, 2001.

(51) Int. Cl.[7] ..... C10M 141/10

(52) U.S. Cl. ..... 508/322; 508/419; 508/433; 508/436; 508/569

(58) Field of Search ..... 508/436, 569, 508/433, 322

(56) References Cited

U.S. PATENT DOCUMENTS

| | | | | |
|---|---|---|---|---|
| 3,267,033 A | | 8/1966 | Allen | |
| 5,176,840 A | | 1/1993 | Campbell et al. | |
| 5,225,093 A | | 7/1993 | Campbell et al. | |
| 5,354,484 A | | 10/1994 | Schwind et al. | |
| 5,358,650 A | | 10/1994 | Srinivasan et al. | |
| 5,492,638 A | | 2/1996 | Wallace et al. | |
| 5,552,068 A | * | 9/1996 | Griffith | 508/436 |
| 5,571,445 A | * | 11/1996 | Srinivasan et al. | 508/189 |
| 5,691,283 A | | 11/1997 | Pont et al. | |
| 5,700,764 A | * | 12/1997 | Walters et al. | 508/338 |
| 5,763,372 A | | 6/1998 | Tersigni et al. | |
| 5,843,874 A | | 12/1998 | Macpherson et al. | |
| 5,942,470 A | | 8/1999 | Norman et al. | |
| 5,968,880 A | * | 10/1999 | Mathur et al. | 508/431 |
| 6,096,691 A | * | 8/2000 | Conary et al. | 508/189 |
| 6,573,223 B1 | * | 6/2003 | Vinci | 508/192 |

FOREIGN PATENT DOCUMENTS

| | | |
|---|---|---|
| EP | 0 391 653 A2 A3 | 10/1990 |
| EP | 0 531 000 A1 | 3/1993 |
| EP | 0 677 570 A1 | 10/1995 |
| EP | 0 695 798 A2 A3 | 2/1996 |
| EP | 0 695 799 A2 A3 | 2/1996 |
| EP | 0 744 456 A2 | 11/1996 |
| EP | 1 057 883 A2 A3 | 12/2000 |
| WO | WO 95/06094 A1 | 3/1995 |
| WO | WO 95/20592 A1 | 8/1995 |
| WO | WO-00/01790 A1 | 1/2000 |

OTHER PUBLICATIONS

Smalheer et al, "Lubricant Additives", Section I–Chemistry of Additives, p. 1–11, 1967.*

* cited by examiner

*Primary Examiner*—Ellen M. McAvoy
(74) *Attorney, Agent, or Firm*—Dennis H. Rainear

(57) ABSTRACT

Gear oils meeting GL-5 specifications are obtained by blending a base oil, a thermally stable phosphorus-containing anti-wear agent; and a metal-free sulfur-containing extreme-pressure agent; wherein the thermally stable phosphorus-containing anti-wear agent is present in an amount sufficient to provide from 100 to 350 ppm phosphorus to the formulated gear oil and wherein the metal-free sulfur-containing extreme-pressure agent is present in an amount sufficient to provide at least 10,000 ppm sulfur to the formulated gear oil and wherein the formulated gear oil contains 350 ppm of phosphorus or less.

21 Claims, No Drawings

LOW PHOSPHORUS CLEAN GEAR FORMULATIONS

CROSS REFERENCE TO RELATED APPLICATIONS

This application claims the benefit of priority under 35 U.S.C. §119(e) to U.S. Provisional Application Ser. No. 60/269,913, filed Feb. 20, 2001, the entire disclosure and contents of which are incorporated herein by reference for all purposes.

STATEMENT REGARDING FEDERALLY SPONSORED RESEARCH

This research was not sponsored by any entity of the Federal Government.

TECHNICAL FIELD

This invention relates to gear oil formulations containing low levels of phosphorus which provide clean gear performance and are capable of meeting the American Petroleum Institute's (API) GL-5 service classification requirements without the need for metal detergents, boron-containing additives, ashless dispersants, dispersant viscosity index improvers or dispersant pour point depressants.

BACKGROUND OF THE INVENTION

This invention relates to gear oils for use in automotive transmissions and final drive axles. More particularly, this invention relates to gear oils that can meet GL-5 performance requirements while also meeting the L-60-1 test performance criteria of API MT-1.

Although a substantial number of gear oils have been produced having various needed properties where such gear oils are used, there exists a need for an additive or a combination of additives to provide an improved clean performing gear oil that can be used, e.g., in manual transmission oils and axle lubricants to reduce the deposits (i.e., build-up of sludge and other unwanted materials on metal surfaces such as carbon and varnish). While acceptable performance of the gear oil is a requirement, it is also highly desirable that the additive or additives be low in cost and easily produced.

Original equipment manufacturers desire lubricants having extended "drain capabilities" whereby their customers can operate the equipment for longer periods of time or for greater distances before draining the transmission or gear box of lubricant and replacing it with fresh lubricant. In view of the competitive situations in which they operate, lubricant manufacturers are also desirous of having the ability to provide low cost lubricants having these prolonged service capabilities. The invention realizes this cost savings through the omission of the costly ashless dispersants and dispersant viscosity index improvers.

Actual drainage periods utilized will depend, to a large extent, upon the type of severity of service and the design of the equipment. The present invention will allow under certain circumstances extended drainage intervals for many axle and transmission applications.

U.S. Pat. Nos. 5,176,840 and 5,225,093 to Campbell et al. disclose a gear oil additive package that includes: (1) an oil soluble succinimide and (2) a boronated or non-boronated carboxylic-type derivative composition produced by reacting a substituted succinic acylating agent with an amine and/or an alcohol. These patents also disclose that other components well known in the gear oil art can be added to the formulation. These other components include extreme pressure and anti-wear agents, defoamers, demulsifiers, antioxidants, dyes, pour point depressants and diluents. These references do not suggest or disclose an improved gear oil that is essentially devoid of carboxylic-type-type ashless dispersants such as the succinimides and Mannich base dispersants.

U.S. Pat. No. 5,354,484 discloses functional fluid compositions comprising (A) a major amount of an oil of lubricating viscosity, and a minor amount of (B-1) at least one soluble tertiary aliphatic primary amine salt of a substituted phosphoric acid composition, and (C) at least one soluble nitrogen-containing composition prepared by the reaction of a hydrocarbon-substituted succinic acid-producing compound with at least about one-half equivalent, per equivalent of acid producing compound, of an amine containing at least one hydrogen attached to a nitrogen atom. Preferably, the amine salts of the phosphoric acids utilized in the lubricating compositions of the present invention are derived from primary amines, and the soluble nitrogen-containing compositions (C) also contain boron.

U.S. Pat. No. 5,358,650 to Srinivasan et al. discloses an all-synthetic gear oil composition that comprises a base oil and a number of components such as organic sulfur-containing antiwear and/or extreme pressure agents, an organic phosphorus-containing anti-wear and/or extreme pressure agent, a copper corrosion inhibitor, a rust inhibitor, a foam inhibitor and an ashless dispersant such as the Mannich base dispersants or the polyamine succinimides.

U.S. Pat. No. 5,492,638 discloses gear oils comprising at least one overbased alkali or alkaline earth metal carboxylate, sulphonate or sulphurized phenate having a TBN of at least 200 in a gear oil which comprises an oil of lubricating viscosity at least 80% by volume of which is mineral oil, synthetic ester oil or a mixture thereof, Mannich base ashless dispersant; metal-free, sulphur-containing antiwear and/or extreme pressure agent; and metal-free, phosphorus-containing and nitrogen-containing antiwear and/or extreme pressure agent. The resultant gear oils exhibit excellent performance when used in synchromesh-based transmissions.

U.S. Pat. No. 5,691,283 discloses lubricant formulations for use in a motor vehicle, especially a heavy duty motor vehicle, having a transmission equipped with at least one cone-type synchronizer and an axle or differential gearing, the same lubricant is used for both such mechanisms. The lubricant has a viscosity grade level of from SAE 75W90 to SAE 85W140 and comprises base oil containing at least (i) Mannich base ashless dispersant; (ii) metal-free, sulphur-containing antiwear and/or extreme pressure agent; (iii) metal-free, phosphorus-containing and nitrogen-containing antiwear and/or extreme pressure agent; and (iv) overbased alkali or alkaline earth metal carboxylate, sulphonate or sulphurized phenate having a TBN of at least 145. The lubricant contains at most, if any, 100 ppm of metal as one or more metal-containing additive components other than (iv).

U.S. Pat. No. 5,763,372 discloses a clean gear boron-free gear additive employing a boron-free ashless dispersant, a sulfur source and a phosphorus source. More particularly, the preferred boron-free ashless dispersant is a hydrocarbyl succinimide. This additive composition when blended with a suitable base oil meets MT-1 and MIL-PRF-2105E requirements without the need for boron. MT-1 is a requirement for a clean gear manual transmission oil. MIL-PRF-2105E is a requirement for a rear axle oil.

U.S. Pat. No. 5,843,874 discloses a clean performing gear oil for use in transmission oils and axle lubricants. The gear oil having a Brookfield Viscosity at −12° C. ranging from about 1,000 to about 150,000 cP, comprises a base oil having a kinematic viscosity at 100° C. ranging from about 4.0 to about 41.0 cSt. Combined with the base oil is preferably a dispersant pour point depressant and/or a dispersant viscosity index improver. In a further embodiment, the gear oil is essentially devoid of carboxylic-type ashless dispersants (e.g., succinimide dispersants) and Mannich base dispersants, thus realizing a cost saving over conventional gear oils which are used as transmission and axle lubricants. Functionalized polymethylacrylates (PMA) are disclosed as agents that improve the properties of the gear oil and allow for the omission of conventional dispersants.

U.S. Pat. No. 5,942,470 discloses gear oils and gear oil additive concentrates of enhanced positraction performance. The gear oils comprise (i) at least one oil-soluble sulfur-containing extreme pressure or antiwear agent; (ii) at least one oil-soluble amine salt of a partial ester of an acid of phosphorus; and (iii) at least one oil-soluble succinimide. These compositions preferably contain one, more preferably two, and most preferably all three of the following additional components: (iv) at least one amine salt of a carboxylic acid; (v) at least one nitrogen-containing ashless dispersant; and (vi) at least one trihydrocarbyl ester of a pentavalent acid of phosphorus.

WO 00/01790 discloses a lubricating composition comprising a major amount of an oil of lubricating viscosity and (A) a di or trihydrocarbyl phosphite, (B) at least one reaction product of a di or trihydrocarbyl phosphite and sulfur or a source of sulfur; at least one di or trihydrocarbyl monothiophosphate; or salt thereof, and (C) a salt of a hydrocarbyl phosphoric acid ester. In one embodiment, the lubricant composition contains less than 0.1% phosphorus or less than about 0.75% borated dispersant.

SUMMARY OF THE INVENTION

The present invention relates to a gear oil having an improved cleanliness performance comprising:

a) a base oil;

b) a thermally stable phosphorus-containing anti-wear agent; and c) a metal-free sulfur-containing extreme-pressure agent;

wherein component (b) is present in an amount sufficient to provide from 100 to 350 ppm phosphorus to the formulated gear oil and wherein component (c) is present in an amount sufficient to provide at least 10,000 ppm sulfur to the formulated gear oil and wherein the formulated gear oil contains 350 ppm of phosphorus or less.

In a preferred embodiment, the gear oil according to the invention is essentially devoid of ashless dispersants, dispersant viscosity index improvers and dispersant pour point depressants. Without these common additives, costs associated with the production of the inventive gear oil are reduced and surprisingly without sacrificing the clean performance of the gear oils.

In addition, the invention provides low cost gear lubricants and gear lubricant additive packages that provide prolonged effective service life. The invention also relates to methods for reducing the sludge production in a lubricated gear box (i.e., an automotive manual transmission) or axles, the method comprising the placement of a gear oil according to this invention in the gear box or axles. In similar fashion, the present invention discloses a method for reducing carbon and varnish production in a gear box or axle.

In preferred embodiments, lubricants are provided which are useful as transmission oils for heavy-duty service, or as axle oils, and as gear oils for all types of service including heavy-duty service.

Moreover, this invention makes it possible to provide so-called "total driveline" lubricants whereby the same lubricant composition can be used for the operation of both the transmission and the axle or differential gearing system. Additionally, the invention enables the achievement of the foregoing advantages with lubricants which are free of metal-containing additive components in that the lubricants may contain as the only metal-containing additive component(s) thereof, a friction-modifying amount of one or more alkali or alkaline earth metal-containing additive components wherein the total concentration of such metal(s) in the finished gear oil is kept very low. That is, the total concentration of such metal(s) in the finished gear oil is at a maximum amount of about 25 ppm. When referring to the gear oil as being metal free, the presence of boron and phosphorous are not considered metals. Further, the invention allows for the omission of ashless dispersants as well as dispersant viscosity index improvers and dispersant pour point depressants. In an additional embodiment, the gear oil formulations of the present invention are free of boron-containing additives.

DETAILED DESCRIPTION OF THE PREFERRED EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The present invention is directed to providing a clean performing lubricant useful as an automotive transmission gear oil and axle lubricant. The term "clean performing gear oil", as used herein, means that when the inventive gear oils are tested in the L-60-1 Test (also referred to as ASTM D 5704-98), gears at the end of the test are acceptably clean according to specified rating procedures for carbon, varnish and sludge.

According to the present invention, the finished gear oils may have different primary viscosity grades which are indicated by the maximum temperature for viscosity of 150,000 cP according to ASTM D 2983 as defined in SAE J306 Automotive Gear and Lubricant Viscosity Classification.

Base Oils

Typically, the gear oils will contain from about 80 to about 98 percent by weight of base oil. The gear oils in which the compositions of this invention are employed can be based on natural or synthetic oils, or blends thereof, provided the lubricant has a suitable viscosity for use in gear oil applications. Thus, the base oils will normally have a viscosity in the range of SAE 50 to SAE 250, and more usually will range from SAE 70W to SAE 140. Suitable automotive gear oils also include cross-grades such as 75W-140, 80W-90, 85W-140, 85W-90, and the like.

Basestocks suitable for use in the present invention may be made using a variety of different processes including but not limited to distillation, solvent refining, hydrogen processing, oligomerisation, esterification, and re-refining. API 1509 "Engine Oil Licensing and Certification System" Fourteenth Edition, December 1996 states that all basestocks are divided into five general categories:

Group I contain less than 90% saturates and/or greater than 0.03% sulfur and have a viscosity index greater than or equal to 80 and less than 120;

Group II contain greater than or equal to 90% saturates and less than or equal to 0.03% sulfur and have a viscosity index greater than or equal to 80 and less than 120;

Group III contain greater than or equal to 90% saturates and less than or equal to 0.03% sulfur and have a viscosity index greater than or equal to 120;

Group IV are polyalphaolefins (PAO); and

Group V include all other basestocks not included in Group I, II, III or IV.

The test methods used in defining the above groups are ASTM D2007 for saturates; ASTM D2270 for viscosity index; and one of ASTM D2622, 4294, 4927 and 3120 for sulfur.

Group IV basestocks, i.e. polyalphaolefins (PAO) include hydrogenated oligomers of an alpha-olefin, the most important methods of oligomerisation being free radical processes, Ziegler catalysis, and cationic, Friedel-Crafts catalysis.

The polyalphaolefins typically have viscosities in the range of 2 to 100 cSt at 100° C., preferably 4 to 8 cSt at 100° C. They may, for example, be oligomers of branched or straight chain alpha-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures.

Regarding the balance of the basestock referred to above, a "Group I basestock" also includes a Group I basestock with which basestock(s) from one or more other groups is or are admixed, provided that the resulting admixture has characteristics falling within those specified above for Group I basestocks.

Preferred basestocks include Group I basestocks and mixtures of Group II basestocks with Group I bright stock.

The present invention may take the form of a concentrate containing the phosphorus anti-wear, the sulfur-containing extreme pressure agent and a diluent oil. Optionally, other components, e.g., diluents, defoamers, demulsifiers, copper corrosion inhibitors, antioxidants, pour point depressants, rust inhibitors and friction modifiers, may be present in the gear oil or gear additive concentrate.

The weight ratios of components (b) and (c) in the additive concentrates of this invention will be at levels sufficient to provide 100 to 350 ppm phosphorus and at least 10,000 ppm sulfur to the formulated gear oil when the concentrate is used at its recommended dosage in oleaginous liquid.

The gear oils and gear oil additive concentrates of this invention can contain various other conventional additives to partake of their attendant functions. These include, for example, the following materials:

Defoamers suitable for use in the present invention include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate and polyacrylates. Defoamers are generally employed at concentrations of up to about 1% in the additive concentrate.

Typical additives which may be employed as demulsifiers in gear oils include alkyl benzene sulfonates, polyethylene oxides, polypropylene oxides, esters of oil soluble acids and the like. Such additives are generally employed at concentrations of up to about 3% in the additive concentrate.

Copper corrosion inhibitors include as thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and2,5-bis-(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyldithio)-1,3,4-thiadiazoles, a number of which are available as articles of commerce. Other suitable inhibitors of copper corrosion include ether amines; polyethoxylated compounds such as ethoxylated amines, ethoxylated phenols, and ethoxylated alcohols; imidazolines; and the like. See, for example, U.S. Pat. Nos. 3,663,561 and 4,097,387. Concentrations of up to about 3% in the concentrate are typical. Preferred copper corrosion inhibitors include ashless dialkyl thiadiazoles. One example of a commercially available ashless dialkyl thiadiazole is HiTEC® 4313 corrosion inhibitor, available from Ethyl Corporation.

Dialkyl thiadiazoles suitable for the practice of the instant invention are of the general formula:

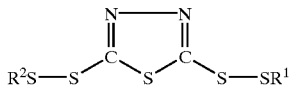

wherein $R^1$ is a hydrocarbyl substituent having from 6 to 18 carbon atoms; $R^2$ is a hydrocarbyl substituent having from 6 to 18 carbon atoms; and may be the same as or different from $R^1$. Preferably, $R^1$ and $R^2$ are about 9–12 carbon atoms, and most preferably $R^1$ and $R^2$ are each 9 carbon atoms.

Mixtures of dialkyl thiadiazoles of formula (I) with monoalkyl thiadiazoles may also be used within the scope of the present invention. Such mono alkyl thiadiazoles occur when either substituent $R^1$ or $R^2$ is H.

Antioxidants that may be employed in gear oil formulations include phenolic compounds and amines. Amounts of up to about 5% in the concentrate are generally sufficient.

The compositions of the present invention may include one or more antioxidants, for example, one or more phenolic antioxidants, hindered phenolic antioxidants, additional sulfurized olefins, aromatic amine antioxidants, secondary aromatic amine antioxidants, sulfurized phenolic antioxidants, oil-soluble copper compounds and mixtures thereof.

Suitable exemplary compounds include include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenyl amine, alkylated diphenylamine and phenyl-α-naphthyl amine.

In the class of amine antioxidants, oil-soluble aromatic secondary amines; aromatic secondary monoamines; and others are suitable. Suitable aromatic secondary monoamines include diphenylamine, alkyl diphenylamines containing 1 to 2 alkyl substituents each having up to about 16 carbon atoms, phenyl-α-naphthylamine, alkyl- or aralkyl-substituted phenyl-α-naphthylamine containing one or two alkyl or aralkyl groups each having up to about 16 carbon atoms, alkyl- or aralkyl-substituted phenyl-α-naphthylamine containing one or two alkyl or aralkyl groups each having up to about 16 carbon atoms, alkylated p-phenylene diamines available from Goodyear under the tradename "Wingstay 100" and from Uniroyal, and similar compounds.

In the class of phenolic antioxidants, suitable compounds include ortho-alkylated phenolic compounds, e.g. 2-tert-butylphenol, 2,6-di-tertbutylphenol, 4-methyl-2,6-di-tertbutylphenol, 2,4,6-tri-tertbutylphenol, and various analogs and homologs or mixtures thereof; one or more partially sulfurized phenolic compounds as described in U.S. Pat. No. 6,096,695, the disclosure of which is incorporated herein by reference; methylene-bridged alkylphenols as described in U.S. Pat. No. 3,211,652, the disclosure of which is incorporated herein by reference.

Antioxidants may be optionally included in the fully formulated final inventive lubricating composition at from about 0.00 to about 5.00 weight percent, more preferably from about 0.01 weight % to about 1.00 weight %.

Rust inhibitors will typically be used in the practice of the present invention. This may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, oleic acid, linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid, and the like; long-chain alpha,omega-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. Especially preferred rust inhibitors for use in the present invention include the primary and secondary amine compounds taught herein as the amine portion of the salt of a phosphoric acid ester as well as mixtures of said amines with other rust inhibitors described above. When an amine salt of a phosphoric acid ester is used as the phosphorus-containing anti-wear agent of the present invention, it may not be necessary to add additional amine-containing rust inhibitors to the gear oil formulation. In a preferred embodiment, the primary and secondary amines will contribute from 40 to 125 ppm nitrogen (on a weight/weight basis) to the formulated gear oil, whether they are classified as a rust inhibitor, part of the anti-wear system or a combination of both.

Friction modifiers may also be included to provide, for example, limited slip performance and enhanced positraction performance. The compositions of the present invention may optionally contain one or more friction modifiers. These typically include such compounds as fatty amines or ethoxylated fatty amines, aliphatic fatty acid amides, ethoxylated aliphatic ether amines, aliphatic carboxylic acids, glycerol esters, aliphatic carboxylic ester-amides and fatty imidazolines, fatty tertiary amines, wherein the aliphatic group usually contains above about eight carbon atoms so as to render the compound suitably oil soluble. Also suitable are aliphatic substituted succinimides formed by reacting one or more aliphatic succinic acids or anhydrides with ammonia or other primary amines.

The additive concentrates of this invention preferably contain a suitable diluent, most preferably an oleaginous diluent of suitable viscosity. Such diluent can be derived from natural or synthetic sources. Among the mineral (hydrocarbonaceous) oils are paraffin base, naphthenic base, asphaltic base and mixed base oils. Typical synthetic base oils include polyolefin oils (especially hydrogenated α-olefin oligomers), alkylated aromatic, polyalkylene oxides, aromatic ethers, and carboxylate esters (especially diester oils), among others. Blends of natural and synthetic oils can also be used. The preferred diluents are the light hydrocarbon base oils, both natural or synthetic. Generally the diluent oil will have a viscosity in the range of 13 to 35 centistokes at 40° C.

In a preferred embodiment, the inventive gear oil is essentially devoid of conventional, ashless dispersants such as carboxylic-type ashless dispersants, Mannich base dispersants and the post-treated dispersants of these types as well as dispersant viscosity index improvers and dispersant pour point depressants. The ashless dispersants that can be eliminated from the gear oil of this invention include the polyamine succinimides, the alkenyl succinic acid esters and diesters of alcohols containing 1–20 carbon atoms and 1–6 hydroxyl groups, alkenyl succinic ester-amide mixtures and Mannich dispersants.

Phosphorus-containing Anti-wear Agents

Component (b) comprises one or more thermally stable phosphorus containing anti-wear agents. Suitable phosphorus-containing anti-wear agents include oil-soluble amine salts of a phosphoric acid ester, such as those taught in U.S. Pat. Nos. 5,354,484 and 5,763,372; and reaction products of dicyclopentadiene and a thiophosphoric acid.

The amine salts of a phosphoric acid ester may be prepared by reacting a phosphoric acid ester with ammonia or a basic nitrogen compound, such as an amine. The salts may be formed separately, and then the salt of the phosphoric acid ester may be added to the lubricating composition.

The phosphoric acid esters useful in preparing the amine salts of the present invention may be characterized by the formula

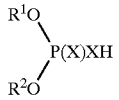

(I)

wherein $R^1$ is hydrogen or a hydrocarbyl group, $R^2$ is a hydrocarbyl group, and both X groups are either O or S.

A preferred method of preparing compositions containing (I) comprises reacting at least one hydroxy compound of the formula ROH with a phosphorus compound of the formula $P_2X_5$ wherein R is a hydrocarbyl group and X is O or S. The phosphorus-containing compositions obtained in this manner are mixtures of phosphorus compounds, and are generally mixtures of mono- and dihydrocarbyl-substituted phosphoric and/or dithiophosphoric acids depending on a choice of phosphorus reactant (i.e., $P_2O_5$ or $P_2S_5$).

The hydroxy compound used in the preparation of the phosphoric acid esters of this invention are characterized by the formula ROH wherein R is a hydrocarbyl group. The hydroxy compound reacted with the phosphorus compound may comprise a mixture of hydroxy compounds of the formula ROH wherein the hydrocarbyl group R contains from about 1 to 30 carbon atoms. It is necessary, however, that the amine salt of the substituted phosphoric acid ester ultimately prepared is soluble in the lubricating compositions of the present invention. Generally, the R group will contain at least 2 carbon atoms, typically 3 to 30 carbon atoms.

The R group may be aliphatic or aromatic such as alkyl, aryl, alkaryl, aralkyl and alicyclic hydrocarbon groups. Examples of useful hydroxy compounds of the formula ROH includes, for example, ethyl alcohol, iso-propyl, n-butyl alcohol, amyl alcohol, hexyl alcohol, 2-ethyl-hexyl alcohol, nonyl alcohol, dodecyl alcohol, stearyl alcohol, amyl phenol, octyl phenol, nonyl phenol, methyl cyclohexanol, alkylated naphthol, etc.

The preferred alcohols, ROH, are aliphatic alcohols and more particularly, primary aliphatic alcohols containing at least about 4 carbon atoms. Accordingly, examples of the preferred monohydric alcohols ROH which are useful in the present invention include, amyl alcohol, 1-octanol, 1-decanol, 1-dodecanol, 1-tetradecanol, 1-hexadecanol, 1-octadecanol, oleyl alcohol, linoleyl alcohol, linolenyl alcohol, phytol, myricyl alcohol, lauryl alcohol, myristyl alcohol, cetyl alcohol, stearyl alcohol and behenyl alcohol. Commercial alcohols (including mixtures) are contemplated herein, and these commercial alcohols may comprise minor amounts of alcohols which, although not specified herein, do not detract from the major purposes of this invention.

The molar ratio of the hydroxy compound ROH to phosphorus reactant $P_2X_5$ in the reaction should be within the range of from about 1:1 to about 4:1, the preferred ratio being 3:1. The reaction may be effected simply by mixing the two reactants at an elevated temperature such as temperatures above about 50° C. up to the composition temperature of any of the reactants or the desired product. Preferably, the temperature is between about 50° C. and 150° C., and is most often below about 100° C. The reaction may be carried out in the presence of a solvent which facilitates temperature control and mixing of the reactants. The solvent may be any inert fluid substance in which either one or both reactants are soluble, or the product is soluble. Such solvents include benzene, toluene, xylene, n-hexane, cyclohexane, naphtha, diethyl ether carbitol, dibutyl ether dioxane, chlorobenzene, nitrobenzene, carbon tetrachloride or chloroform.

The product of the above reaction is acidic, but its chemical constitution is not precisely known. Evidence indicates, however, that the product is a mixture of acidic phosphates consisting predominantly of the mono- and di-esters of phosphoric acid (or thio- or dithiophosphoric acid), the ester group being derived from the alcohol ROH.

The amine salts of the present invention can be prepared by reaction of the above-described phosphoric acid esters such as represented by Formula I with at least one amino compound which may be a primary or secondary. Preferably the amines which are reacted with the substituted phosphoric acids to form the amine salts are primary hydrocarbyl amines having the general formula $$R'NH_2$$

wherein R' is a hydrocarbyl group containing up to about 150 carbon atoms and will more often be an aliphatic hydrocarbyl group containing from about 4 to about 30 carbon atoms.

In one preferred embodiment, the hydrocarbyl amines which are useful in preparing the amine salts of the present invention are primary hydrocarbyl amines containing from about 4 to about 30 carbon atoms in the hydrocarbyl group, and more preferably from about 8 to about 20 carbon atoms in the hydrocarbyl group. The hydrocarbyl group may be saturated or unsaturated. Representative examples of primary saturated amines are those known as aliphatic primary fatty amines and commercially known as "Armeen®" primary amines (products available from Akzo Nobel Chemicals, Chicago, Ill.). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides and imides will form in reactions with the amines of technical grade. Also suitable are mixed fatty amines such as Akzo's Armeen-C, Armeen-O, Armeen-OL, Armeen-T, Armeen-HT, Armeen-S and Armeen-SD.

In another preferred embodiment, the amine salts of the composition of this invention are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

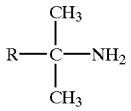

wherein R is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JM-T" which is a similar mixture of $C_{18}$–$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are quite useful. Thus, the R' and R" groups may contain one or more olefinic unsaturation depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

Secondary amines include dialkylamines having two of the above alkyl groups including such commercial fatty secondary amines as Armeen-2C and Armeen-2HT, and also mixed dialkylamines where R' is a fatty amine and R" may be a lower alkyl group (1–9 carbon atoms) such as methyl, ethyl, n-propyl, i-propyl, butyl, etc., or R" may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono-or dialkyl, symmetrical or asymmetrical ethylene diamines, propane diamines (1,2, or 1,3), and polyamine analogs of the above. Suitable commercial fatty polyamines are available under the Duomeen® tradename from Akzo Nobel. Suitable polyamines include Duomeen C (N-coco-1,3-diaminopropane), Duomeen S (N-soyaalkyl trimethylenediamine), Duomeen T (N-tallow-1,3-diaminopropane), or Duomeen OL (N-oleyl-1,3-diaminopropane).

The oil-soluble amine salts may be prepared by mixing the above-described phosphoric acid esters with the above-described amines at room temperature or above. Generally, mixing at room temperature for a period of from up to about one hour is sufficient. The amount of amine reacted with the phosphoric acid ester to form the salts of the invention is at least about one equivalent weight of the amine (based on nitrogen) per equivalent of phosphoric acid, and the ratio of equivalents generally is about one.

Methods for the preparation of such amine salts are well known and reported in the literature. See for example, U.S. Pat. Nos. 2,063,629; 2,224,695; 2,447,288; 2,616,905; 3,984,448; 4,431,552; 5,354,484; Pesin et al, *Zhurnal Obshchei Khimii*, Vol, 31, No. 8, pp. 2508–2515 (1961); and PCT International Application Publication No. WO 87/07638.

Alternatively, in a preferred embodiment the salts may be formed in situ when the acidic phosphoric acid ester is blended with the above-described amines when forming a gear oil concentrate or the formulated gear oil itself. For example, primary hydrocarbyl amines that function as rust inhibitors may be added to a gear additive concentrate containing the acidic phosphoric acid ester leading to the formation of amine salts of phosphoric acid esters.

Another preferred thermally stable phosphorus-containing anti-wear agent for use in the present invention comprises the reaction products of dicyclopentadiene and thiophosphoric acids, also referred to herein as dicyclopentadiene dithioates. Thiophosphoric acids suitable for use in preparing the anti-wear agents have the formula:

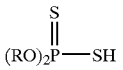

wherein R is a hydrocarbyl group having from 2 to 30, preferably 3 to 18 carbon atoms. In a preferred embodiment, R comprises a mixture of hydrocarbyl groups containing from 3 to 18 carbon atoms.

The dicyclopentadiene dithioates may be prepared by mixing dicyclopentadiene and a dithiophosphoric acid for a time and temperature sufficient to react the thioacid with the dicylcopentadiene. Typical reaction times range from 30 minutes to 6 hours, although suitable reaction conditions can readily be determined by one skilled in the art. The reaction product may be subjected to conventional post-reaction work up including vacuum stripping and filtering.

Sulfur-containing Extreme Pressure Agents

The gear oils of the present invention contain as component (c) at least one metal-free sulfur-containing extreme pressure (EP) agent. Preferably, the sulfur-containing extreme pressure agents contain at least 25 percent by weight sulfur. The amount of said EP agent added to the gear oil will be sufficient to provide at least 10,000 ppm sulfur, more preferably 10,000 to 30,000 ppm sulfur and most preferably 12,000 to 25,000 ppm sulfur in the finished gear oil from component (c).

A wide variety of sulfur-containing extreme pressure or antiwear agents are available for use in the practice of this invention. Among suitable compositions for this use are included sulfurized animal or vegetable fats or oils, sulfurized animal or vegetable fatty acid esters, fully or partially esterified esters of trivalent or pentavalent acids of phosphorus, sulfurized olefins (see for example U.S. Pat. Nos. 2,995,569; 3,673,090; 3,703,504; 3,703,505; 3,796,661; 3,873,545; 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), sulfurized Diels-Alder adducts (see for example U.S. Pat. Nos. 3,632,566; 3,498,915; and Re No. 27,331), sulfurized dicyclopentadiene (see for example U.S. Pat. Nos. 3,882,031 and 4,188,297), sulfurized or co-sulfurized mixtures of fatty acid esters and monounsaturated olefin (see for example U.S. Pat. Nos. 4,149,982; 4,166,796; 4,166,797; 4,321,153; 4,481,140), co-sulfurized blends of fatty acid, fatty acid ester and α-olefin (see for example U.S. Pat. No. 3,953,347), functionally-substituted dihydrocarbyl polysulfides (see for example U.S. Pat. No. 4,218,332), thia-aldehydes, thia-ketones and derivatives thereof (e.g., acids, esters, imines, or lactones) (see for example, U.S. Pat. No. 4,800,031; and PCT International Application Publication No. WO 88/03552), epithio compounds (see for example, U.S. Pat. No. 4,217,233), sulfur-containing acetal derivatives (see for example U.S. Pat. No. 4,248,723), co-sulfurized blends of terpene and acyclic olefins (see for example U.S. Pat. No. 4,584,113), and polysulfide olefin products (see for example U.S. Pat. No. 4,795,576).

Preferred materials useful as component (i) are sulfur-containing organic compounds in which the sulfur-containing species are bound directly to carbon or to more sulfur.

One particularly preferred class of such agents is made by reacting an olefin, such as isobutene, with sulfur. The product, e.g., sulfurized isobutene, preferably sulfurized polyisobutylene, typically has a sulfur content of 10 to 55%, preferably 30 to 50% by weight. A wide variety of other olefins or unsaturated hydrocarbons, e.g., isobutene dimer or trimer, may be used to form such agents.

Another particularly preferred class of such agents is that of polysulfides composed of one or more compounds represented by the formula: $R^6$—$S_x$—$R^7$ where $R^6$ and $R^7$ are hydrocarbyl groups each of which preferably contains 3 to 18 carbon atoms and x is preferably in the range of from 2 to 8, and more preferably in the range of from 2 to 5, especially 3. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) are preferred. Examples of other useful dihydrocarbyl polysulfides include the diamyl polysulfides, the dinonyl polysulfides, the didodecyl polysulfides, and the dibenzyl polysulfides.

Although the components above and in the below list are described occasionally with reference to a function, that function may be one of other functions served by the same component and should not be construed as a mandatory limiting function.

The compositions of the present invention may be top treated to achieve multi-functional performance (i.e., both automotive and industrial applications).

The gear oil compositions of the present invention are capable of meeting API GL-5 performance requirements. The specification for GL-5 is set forth in Table 1.

TABLE 1

Performance Requirements for MIL-L-2105D (GL-5) Lubricants (August 1987)

| SAE VISCOSITY GRADE | | 75W | 80W90 | 85W140 |
|---|---|---|---|---|
| CRC L-60 Thermal Oxidation Stability | 100° C. visc. Increase @ 50 hrs., Max. % | 100 | 100 | 100 |
| | Pentane Insolubles, % | 3 | 3 | 3 |
| | Toluene Insolubles, % | 2 | 2 | 2 |
| CRC L-33, 7 Day Moisture Corrosion | Rust on gear Teeth | 0 | 0 | 0 |
| | Bearings, Max. % | 1 | 1 | 1 |
| | Rust on Coverplate, Max. % | | | |
| CRC L-37 High Speed-Low Torque High Torque-Low Speed | "Green" Gears | Pass | Pass | NR |
| | "Lubrited" Gears | Pass | Pass | NR |
| CRC L-42 High Speed-Shock Loading Axle Test | Ring & Pinion Tooth Scoring, Max. % | Equal to or better than RGO 110–90 | | NR |
| ASTM D-130 Copper Strip Corrosion | Strip Rating, Max. | 3 | 3 | 3 |

Notes:
NR—Not required, if 80W90 passes in the same base stock
Lower L-37 and L-42 Test Temperatures are required for 75W oils

Oxidation Performance Test: L-60-1 (ASTM D 5704-98)

The L-60-1 test is designed to test the thermal and oxidative stability of a gear oil. New specifications (API MT-1, MIL-PRF-2105E) have stipulated that the limits (i.e., rating) of these new features of carbon/varnish and of sludge are 7.5 MIN (minimum) and 9.4 MIN (minimum), respectively. The maximum percent viscosity rise has been specified to be 100, the pentane insolubles at 3 percent maximum and the toluene insolubles at 2 percent maximum. These features are summarized in Table 2.

TABLE 2

| Parameters | Limits |
|---|---|
| Kinematic Viscosity Increase %, @ 100° C., cSt | 100 max |
| N-Pentane Insolubles, wt % | 3.0 max |
| Toluene Insolubles, wt % | 2.0 max |
| Carbon/Varnish Rating | 7.5 min |
| Sludge Rating | 9.4 min |

If more than one test is conducted, then the average of two test results must meet the above limits. No more than three tests are allowed. When three tests are conducted, one of the three can be discarded and the average of the remaining two tests must meet the above limits.

The L-60-1 test procedure is practically identical to the L-60 test except that the conditions and parameters are more rigorously controlled in the industry. The Test Monitoring Center (TMC) records and reports the precision of each approved stand within the industry.

The relevance of the rating of the gear surfaces from the L-60-1 test is two-fold. Firstly, clean gears are used to market the lubricant as a positive feature as the industry moves to lubricants with improved oxidation and longer life. Pictures of the gears are often used in marketing the lubricant. Secondly, it is hypothesized in the industry that the deposits that build up on the shafts of the pinions of the gears during application cause an increase of friction with the seal and, thus, lead to premature seal erosion and even failure. It is, thus, important for both commercial and practical reasons to be able to market gear lubricant technology that exhibits enhanced performance in the L-60-1 test.

The tests for L-60-1 carbon varnish and sludge rating involve employing the lubricating oil to lubricate a large gear and a small gear which mesh with each other in a test apparatus. A carbon/varnish measurement and a sludge measurement is made for the large gear front face, large gear rear face, small gear front face and small gear rear face. The carbon varnish rating is the average of the carbon varnish (CV) measurements of the large gear front face and large gear rear face. The sludge rating is the average of the sludge measurement at all four faces.

In order to show the advantages and effectiveness of the gear oils of this invention, formulated gear oils have been prepared as set forth in Table 3. These formulated gear oils were tested according to the L-60-1 test and the results are set forth in Table 3. The percentages are by weight unless otherwise specified. All of the gear oils in Table 3 contained an identical additive package comprising a sulfurized olefin in an amount sufficient to provide approximately 15,000 ppm of sulfur to the gear oil, an acidic rust inhibitor, a thiadiazole sulfur scavenger, an acrylate anti-foam and a corrosion inhibitor. The calculated amount (ppm) of nitrogen supplied by the primary amines is set forth in the Table (the calculated nitrogen content excludes any nitrogen supplied by the base oil, thiadiazole sulfur scavenger or any other potential source of nitrogen). The L-60-1 carbon varnish (CV) and sludge ratings are set forth in the Table. The phosphorus-containing anti-wear additives in the Table are an amine salt of amyl acid phosphate (AAP), dicyclopentadiene dithioates (DCPD), dibutyl hydrogen phosphite (DBHP) and an amine salt prepared by sulfurization of DBHP in the presence of amine (S-DBHP).

TABLE 3

Gear oil formulations and L-60-1 Results

| Example | ppm N | ppm P | Anti-wear | CV | Sludge |
|---|---|---|---|---|---|
| 1 | 115 | 308 | AAP | 7.5 | 9.4 |
| 2 | 0 | 296 | DCPD | 7.8 | 9.5 |
| 3* | 153 | 412 | AAP | 4.2 | 9.3 |
| 4* | 192 | 516 | AAP | 5.5 | 9.4 |
| 5* | 0 | 310 | DBHP | 6 | 9.5 |
| 6* | 159 | 308 | S-DBHP | 2.3 | 9.4 |

*Comparative example

As shown above, Table 3 sets forth the results obtained when the oils are tested in the L-60-1 gear oil oxidation test. It can be seen that gear oils containing thermally stable phosphorus anti-wear agents amount sufficient to contribute less than 350 ppm phosphorus to the finished oil exhibit passing MT-1 performance in the L-60-1 test. The results in Table 3 show that examples 1 and 2 result in higher carbon varnish ratings than gear oils outside of the scope of the present invention. This indicates that the gear oils of examples 1 and 2 give rise to better oxidation control compared to those of examples 3–6. Improved gear cleanliness as seen in these L-60-1 tests is a very desirable feature for a gear lubricant as explained above.

It is important that the gear oils of the present invention reduce gear distress and deposits. Satisfactory performance may be demonstrated when the oil is tested by the L-37 as described within ASTM STP 512A using untreated and phosphate-treated gear assemblies. The gear oil must prevent gear-tooth ridging, rippling, pitting, welding, spalling, and excessive wear or other surface distress and objectionable deposits and not produce excessive wear, pitting or corrosion of bearing rollers under conditions of low-speed, high-torque.

Preferably, the finished gear oil compositions of this invention are ashless or low-ash compositions, that is, they contain, if any, at most 2,000 parts by weight of metal introduced from one or more of the additional components. More preferably, the finished gear oil contains no more than 500 ppm of metal, and most preferably zero to at most 25 ppm of metal. Accordingly, the additive concentrates of this invention are preferably proportioned such that if one or more metal-containing components (e.g., zinc dihydrocarbyldithiophosphate and/or metal detergent) are included therein, the additive concentrate when employed in a base oil at the selected or recommended dosage level will yield a finished lubricant having at most 2,000 ppm, preferably at most 500 ppm, and more preferably at most 25 ppm of added metal. When one or more metal additives are employed, the metal content thereof most preferably is confined to one or more alkali metals and/or one or more alkaline earth metals. Thus, for example, the preferred compositions are zinc-free. Compositions essentially devoid of added metal content are most especially preferred. In this connection, neither boron nor phosphorous is subject to these preferred limitations on metal content, as neither such element is considered a metal herein. Thus, the mere fact that boron and/or phosphorous components may leave residues during usage, is of no relevance as regards these preferred limitations on metal content. In another preferred embodiment, the gear oil formulations of the present invention are free of boron-containing additives.

Industrial Applicability

The automobile industry is constantly searching for improved lubricating formulations for use in manual transmissions and axles. This invention provides an improved gear oil comprising thermally stable antiwear additives capable of providing passing L-60-1 performance in conventional automotive gear formulations without the use of ashless dispersants, metallic detergents or boron containing additives, while still maintaining GL-5 performance.

The disclosures of each patent or publication cited in the foregoing disclosure are incorporated herein by reference as if fully set forth herein.

While the preferred embodiments have been fully described and depicted for the purposes of explaining the principles of the present invention, it will be appreciated by those skilled in the art that modifications and changes may be made thereto without departing from the scope of the invention set forth in the appended claims.

We claim:

1. A gear oil comprising:

a) a base oil;

b) a thermally stable phosphorus-containing anti-wear agent; and c) a metal-free sulfur-containing extreme-pressure agent;

wherein component (b) is present in an amount sufficient to provide from 100 to 350 ppm phosphorus to the formulated gear oil and wherein component (c) is present in an amount sufficient to provide at least 10,000 ppm sulfur to the formulated gear oil;

wherein the gear oil is essentially free of an ashless dispersant; and wherein the gear oil meets MIL-L-2105D (API GL-5) performance specifications and has an L-60-1 carbon/varnish rating of at least 7.5 and an L-60-1 sludge rating of at least 9.4.

2. The gear oil according to claim 1, wherein said gear oil contains metal-containing additives in a total amount of no more than 2,000 ppm of metal.

3. The gear oil according to claim 1, wherein said gear oil contains metal-containing additives in a total amount of no more than 500 ppm of metal.

4. The gear oil according to claim 1, wherein said gear oil contains metal-containing additives in a total amount of no more than 25 ppm of metal.

5. The gear oil according to claim 1, wherein said gear oil is essentially devoid of ashless dispersants, dispersant viscosity index improvers, and dispersant pour point depressants.

6. The gear oil according to claim 1, wherein the base oil has a viscosity in the range of SAE 50 to SAE 250.

7. The gear oil according to claim 1, wherein the base oil has a viscosity in the range of SAE 70W to SAE 140.

8. The gear oil according to claim 1, wherein the thermally stable phosphorus-containing anti-wear agent is selected from the group consisting of oil-soluble amine salts of a phosphoric ester, and reaction products of dicyclopentadiene and thiophosphoric acid.

9. The gear oil according to claim 1, wherein the metal-free sulfur-containing extreme-pressure agent comprises a sulfur-organic compound including a sulfur-containing species bound directly to carbon or to more sulfur.

10. The gear oil according to claim 1, wherein the metal-free sulfur-containing extreme-pressure agent is selected from the group consisting of sulfurized olefin, and polysulfide composed of one or more groups represented by the formula $R^6$—$S_x$—$R^7$ where $R^6$ and $R^7$ are hydrocarbyl groups each of which contains 3 to 18 carbon atoms and x is in the range of from 2 to 8.

11. A method of manufacturing gear oil comprising blending a base oil, a thermally stable phosphorus-containing anti-wear agent, and a metal-free sulfur-containing extreme-pressure agent in respective amounts effective that the thermally stable phosphorus-containing anti-wear agent is present in an amount sufficient to provide from 100 to 350 ppm phosphorus to the formulated gear oil and wherein the metal-free sulfur-containing extreme-pressure agent is present in an amount sufficient to provide at least 10,000 ppm sulfur to the formulated gear oil and wherein the formulated gear oil contains 350 ppm of phosphorus or less, wherein the gear oil is essentially free of an ashless dispersant and wherein the gear oil meets MIL-L-2105D (API-G-5) performance specifications and has an L-60-1 carbon/varnish rating of at least 7.5 and an L-60-1 sludge rating of at least 9.4.

12. A method of lubricating an automotive gear comprising using as the lubricant for the automotive gear the gear oil of claim 1.

13. A method for reducing sludge production in a gearbox comprising placing a gear oil according to claim 1 in the gearbox.

14. A method for reducing sludge production in an axle comprising placing a gear oil according to claim 1 in the axle.

15. A method for reducing sludge production in an automotive manual transmission comprising using a gear oil according to claim 1.

16. A method for reducing carbon and varnish production in a gearbox comprising placing a gear oil according to claim 1 in the gearbox.

17. A method for reducing carbon and varnish production in an axle comprising placing a gear oil according to claim 1 in the axle.

18. A method for lubricating the driveline of a motor vehicle in which said driveline comprises an automotive manual transmission located in a first housing adapted to hold fluid lubricant for the transmission, and differential axle gearing located in a second housing adapted to hold fluid lubricant, in which the method comprises introducing the gear oil according to claim 1 into both the first and second housings, and sealing both housings effective to retain the fluid lubricant in the first and second housings during ensuing operation of said vehicle.

19. An automotive manual transmission comprising a gear lubricated according to the method of claim 12.

20. A lubed gear box comprising a gear lubricated according to the method of claim 12.

21. A vehicle comprising a lubed gear box according to claim 20.

* * * * *